United States Patent [19]

de Jong et al.

[11] Patent Number: 4,963,931

[45] Date of Patent: Oct. 16, 1990

[54] REGULATING MEANS FOR AUTOMATICALLY ADJUSTING A MARGINING MEANS IN A COPIER TO PRODUCE IMAGE-FREE IMAGE CARRIER ZONES IN RESPONSE TO IMAGE POSITIONING PRIOR TO IMAGE TRANSFER

[75] Inventors: Adrianus de Jong, EK Horst; Hendrikus J. J. van Soest, AP Helden, both of Netherlands

[73] Assignee: OCE Nederland B.V., Venlo, Netherlands

[21] Appl. No.: 891,962

[22] Filed: Jul. 30, 1986

[30] Foreign Application Priority Data

Aug. 5, 1985 [NL] Netherlands ..... 8502186

[51] Int. Cl.[5] ..... G03G 15/00

[52] U.S. Cl. ..... 355/218

[58] Field of Search ..... 355/3 R, 7, 14 SH, 24–26, 355/218

[56] References Cited

U.S. PATENT DOCUMENTS

| | | | |
|---|---|---|---|
| 3,778,148 | 12/1973 | Fujitsuka et al. | 355/3 R |
| 3,809,472 | 5/1974 | Liechty et al. | 355/3 R |
| 3,860,338 | 1/1975 | Reehil | 355/7 X |
| 4,162,844 | 7/1979 | Traister et al. | 355/24 X |
| 4,451,136 | 5/1984 | Tanioka et al. | 355/14 SH |

*Primary Examiner*—Joan H. Pendegrass

*Attorney, Agent, or Firm*—Reed Smith Shaw & McClay

[57] ABSTRACT

A regulating device for copying machines used in forming an image of an original on an image carrier and transferring the formed image onto a receiving material in which the relative position of image and receiving material with respect to each other before the iamge transfer can be adjusted. The copying device is provided with a margining means which in response to said adjustment is automatically adjusted for rendering image-free all the zones of the image carrier in which image and receiving material do not coincide during the image transfer, so as to prevent contamination with image-forming material and the occurrence of undesired deposition of image-forming material on the image receiving material.

3 Claims, 1 Drawing Sheet

REGULATING MEANS FOR AUTOMATICALLY ADJUSTING A MARGINING MEANS IN A COPIER TO PRODUCE IMAGE-FREE IMAGE CARRIER ZONES IN RESPONSE TO IMAGE POSITIONING PRIOR TO IMAGE TRANSFER

FIELD OF THE INVENTION

The invention relates to an image adjusting means for use in a copier and particular to a means which adjusts the margin to provide an image-free zone adjacent to the image to be copied onto the receiving material.

BACKGROUND OF THE INVENTION

It is well known in copying machines to provide margining means for rendering the zones adjacent to the image image-free. Image transfer means are provided for transferring the image onto a receiving material and adjustment means are provided for adjusting the relative position of image and receiving material with respect to each other before transfer of the image.

For example, in U.S. Pat. No. 4,046,467 an electrophotographic copying device is described in which one of a number of fixed areas of an image carrier is brought into contact with a sheet of receiving material when a copy is being made. In this process an image of an original can be formed by projection at one position in that area which is adjustable.

The margining means are automatically adjusted so as to render image-free zones adjacent to the image regardless of the position of the image on the image carrier. A problem with automatic adjustment is that in the case of an adjustment in which the position of the image on the image carrier does not correspond with the position of the receiving sheet, a section of the image is not transferred onto the receiving material but remains present on the image carrier or is transferred onto the image transfer means. In both cases contamination of the copying device with image-forming material occurs.

Contamination of this kind is avoided in prior art copying machines (see, e.g., U.S. Pat. Nos. 4,129,378; 4,046,471 and 4,080,071) by not adjusting the margining means when adjusting the relative position of the image on the image carrier with respect to the receiving material. Rather, the margining means is permanently adjusted to the fixed areas where the receiving material makes contact with the image carrier. However, this method has the disadvantage that a zone next to the image formed on the image carrier may make contact with the receiving material and image-forming material deposited in the zone thus being transferred to the receiving material. Deposits of this kind are produced if the zone is insufficiently exposed, which happens if too little light reaches the image carrier from zones adjacent to an original that is in the exposure position, for example as a result of a shadow effect or through contamination of the plate which covers the original in the exposure position.

Various other means have been attempted including U.S. Pat. Nos. 4,272,180 and 4,501,490. The former patent describes a copier for forming images on opposite sides of the receiving material wherein the adjustment means adjusts the relative position of one of the images and receiving material. The latter patent describes a means for adjusting the relative positions by varying the magnification of the image forming step.

Accordingly, it is an object of the present invention to provide a copying means which overcomes the above mentioned disadvantages. It is a further object of the invention to provide in a copying device regulating means which adjusts the margining means so as to render image-free the zones adjacent to the image and also the zone of the image, which during the image transfer, falls outside the receiving material to prevent contamination with image-forming material and the occurrence of undesired deposition of image-forming material on the receiving material.

SUMMARY OF THE INVENTION

Generally, the object of the present invention is achieved by using a regulating means which controls the adjustment of margining means of the copier.

Preferably, the regulating means are coupled to the copier's adjustment means for adjusting the relative position of the image and receiving material. The result to the adjustment is that the margining means is automatically adjusted for rendering image-free all of the zones in which the image and receiving material do not coincide during the image transfer.

As a result of this, on adjusting the relative position of the image with respect to the receiving material, the margining means are automatically adjusted to the desired margining.

Other advantages of the invention will become apparent from a perusal of the following detailed description of a presently preferred embodiment taken in connection with the accompanying drawing.

PREFERRED EMBODIMENT

Figure 1:
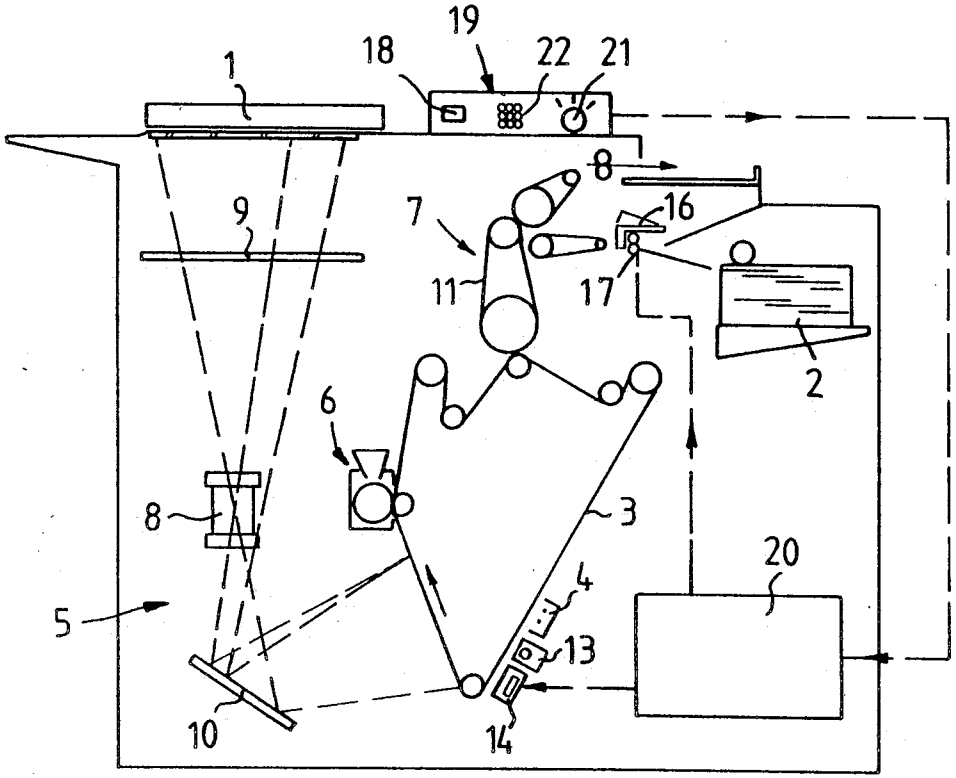
FIG. 1 is a diagrammatic representation of a copier machine in accordance with the present invention.

For the purpose of the description of the present invention the term "image" means an image of the entire original including the margins.

The copier machine shown in FIG. 1 is provided with exposure platen 1 on which an original can be placed and sheet magazine 2 from which sheets of receiving material can be fed through the copying device to receive an image of an original disposed on exposure platen 1. The copier is further equipped with a continuously movable photoconductive belt 3 and processing stations arranged along it for forming an image of an original on belt 3 and transferring the image formed onto a receiving sheet supplied.

These processing stations comprise charging device 4 for applying an electrostatic charge on belt 3, exposure system 5 for exposing charged belt 3 imagewise in accordance with the original, a developing device 6 for the deposition of developing powder on the charged image formed by the imagewise exposure, and an image transfer system 7 which transfers and fixes said powder image to a receiving sheet supplied from magazine 2. Exposure system 5 comprises objective lens 8 which projects an original exposed by means of flashbulb 9 via mirror 10 onto moving photoconductive belt 3. By adjustment of the optical system the imaging ratio can be changed as indicated by broken lines in FIG. 1 so that the size of the image can be matched to the size of the receiving sheet. Image transfer system 7 comprises an endless belt 11 which receives an image developed on photoconductive belt 3 and subsequently transfers it to a sheet of receiving material supplied from magazine 2.

Adjacent to photoconductive belt 3 are positioned longitudinal margining device 13 and a transverse margining device 14 for rendering image-free edge zones of the area of photoconductive belt 3 on which, with the aid of the exposure system 5, an image of the original situated on the exposure platen 1 is imaged. Longitudinal margining device 13 comprises bulbs for the exposure of the zones of the charged photoconductive belt 3 which extend along the side edges of the belt, and the transverse margining device 14 comprises a flashbulb for the exposure of zones of the charged photoconductive belt 3 which extend transversely across the belt. The longitudinal margining device 13 is adjusted to the width of the receiving material present and ensures that in the edge zones of the belt 3 no developing powder can be deposited which in image transfer system 7 would come beside the receiving material. Charging device 4 can be switched off and switched on again at adjustable times to keep the photoconductive belt charge-free, or the transverse margining device 14 can be switched on and off at adjustable times for discharging the photoconductive belt in areas which lie between images produced on the belt, as will be explained in more detail hereinafter.

In the track along which sheets of receiving material from magazine 2 are fed to the image transfer system 7 there are arranged an abutment strip 17 and a pair of conveyor rollers 17. Abutment strip 16 can occupy the operational position shown in solid line in FIG. 1, in which the sheet supplied is held back. A nonoperational position is shown in broken lines in which the sheet held back is fed by driven conveyor rollers 17 at a variable time to image transfer system 7. An adjustment system 19, with which the position and the size of an image-free edge zone can be adjusted on a copy sheet is disposed on the operating panel 18.

Control device 20 is provided for activating functions in a correct time relationship to form an image of an original on exposure platen 1 and transferring the image onto a receiving sheet. Control system 20 is coupled, on the one hand, to adjustment system 19 and on the other hand, to the drive system (not shown) of abutment strip 16 and conveyor roller pair 17 and to the circuit of the flashbulb in the transverse margining device 14. Adjustment system 19 is provided with knob 21 which can be adjusted to three positions, a neutral position in which no displacement of the image with respect to a receiving sheet occurs, a position in which an image displaced to the right is produced on the receiving sheet and a position in which an image displaced to the left is produced on the receiving sheet. Adjustment system 19 is further provided with numerical buttons 22 for adjusting the distance over which the displacement adjusted by knob 21 takes place.

The operation of the copier machine is as follows. If adjustment knob 21 is in the neutral position at start-up, a copying cycle is started. The charging device is switched on for a predetermined fixed period related to the size of the receiving material so as to charge a strip of the continuously moving photoconductive belt and the bulbs of longitudinal margining device 13 and the bulb of transverse margining device 14 are switched on so as to expose the charged strip corresponding to the edges of the receiving material. Flashbulb 9 is ignited so as to expose the charged area of the photoconductor imagewise, and the receiving material is fed up against abutment strip 16. At a predetermined time related to the time of imaging the receiving material is fed to the image transfer system 7, such that in the image transfer system 7 the edges of the receiving material coincide with the edges of the area in which the image developed and transferred to the transfer belt 11 is located.

On exposure platen 1 an original can be placed which is provided with a normal text block. Such an original is placed on the exposure platen with the image side to be copied directed downwards and with the head of the text directed towards the rear side of the copier machine. If knob 21 is set to the neutral position, this original is imaged onto a receiving sheet in a manner such that the margins of the image on the receiving sheet correspond to the margins of the image on the original. The widths of the margins on the receiving sheet may be varied, for example, in order to create an image-free edge for binding. In the case of single-sided printing of receiving sheets which have to be bound together, a larger margin is generally desired in this connection of the left-hand side of the text block that is presented on the original. This means that the image with respect to the receiving sheet has to be displaced to the right. Upon printing these sheets on the rear side, the binding edge on said rear side is on the right-hand side of the text block so that the image on the receiving sheet has to be displaced to the left.

If the adjustment knob 21 is set to the position for displacing the image to the right with respect to the receiving material, then, before a copying cycle can be started, a number must be fed in with the numerical buttons 22 which corresponds to the distance over which the displacement is desired. Upon subsequently operating the start button of the copier machine, a copying cycle is started in which:

A. the charging device 4, in comparison with the normal copying cycle described above, is switched off earlier by an amount such that the charged strip is shorter as much as the distance to which the image displacement has been adjusted;

B. the fixed period in which the transverse margining device 14 is switched on for the exposure of the trailing edge zone of the image area is advanced by an amount such that, in comparison with the normal copying cycle, the strip consequently exposed is displaced over this distance to which the image displacement has been adjusted; and C. the time at which a receiving sheet lying ready in front of the abutment strip 16 is fed to image transfer system 7 is advanced by an amount such that the sheet is displaced over the distance to which the image displacement has been adjusted with respect to the image with which the sheet makes contact in image transfer system 7.

The image on the photoconductive belt 3 is thus automatically margined at the leading edge on the leading edge of the image and at the opposite edge on the trailing edge of the receiving material. Switching off the charging device 4 earlier ensures in that case that if the displacement is larger than the distance at which the transverse margining device 14 is effective, no charged strip can be present outside the image area. Of course the earlier switching off of the charging device must also be regarded as a form of rendering image-free.

If the adjustment knob 21 is set to the position for displacing the image to the left with respect to the receiving sheet, then, before a copying cycle can be started a number must also be fed in with the numerical buttons 22 which correspond to the distance over which the displacement is desired. On subsequently operating the start button, a copying cycle is started in which:

A. the charging device 4 in comparison with the normally performed copying cycle described above, is switched on later by an amount such that the charged strip is shorter by as much as the distance to which the image displacement has been adjusted;

B. the fixed period in which that transverse margining device 14 is switched on for the exposure of the leading edge zone of the image area is delayed by an amount such that, in comparison with the normal copying cycle, the strip consequently exposed is displaced over the distance to which the image displacement has been adjusted; and C. the time at which a receiving sheet lying ready in front of the abutment strip 16 is fed to image transfer system 7 is delayed by an amount such that the sheet is displaced over the distance to which the image displacement has been adjusted with respect to the image with which the sheet makes contact in the image transfer system 7.

The image on the photoconductive belt 3 is thus automatically margined at the leading edge on the leading edge of the receiving sheet and at the opposite edge on the trailing edge of the image. Switching on charging device 4 later ensures in this case that, if the displacement is greater than the distance at which the transverse margining bulb is effective, no charged strip can be present outside the image region.

A displacement of the image with respect to a receiving material and a margining coupled thereto in accordance with the foregoing is often desired in the production of double-sided printed copies from single-sided printed originals to displace only the image on the rear sides of the receiving sheets to the left in order to create a binding edge at the right-hand edge of said rear sides of the sheets. If an original feed system is used which can feed a set of single-sided printed originals in sequence onto the exposure platen, control system 20 can be advantageously designed so that the copier machine automatically performs no image displacement when the front sides of the copy sheets are being printed and carries out an image displacement with respect to the receiving sheet to the left and a margining coupled thereto in accordance with the foregoing when the rear sides of the receiving sheets are being printed. During the printing of the front sides of said receiving sheets the image zones which are situated opposite the image zones rendered image-free on the rear sides, are rendered image-free. Receiving sheets printed double-sided in this way have a completely image-free and background-free edge section which can be used as a binding edge. In this mode of operation and adjustment of the copier machine for the production of double-sided printed copy sheets it is only necessary for the size of the image displacement to be adjusted by means of the numerical buttons 22.

It will be clear that, instead of varying the time at which a receiving sheet is supplied, the image displacement can also be brought about in different manners. For example, displacement can be achieved by varying the time at which flashbulb 9 is ignited or by varying the position of the original on the exposure platen 1.

It will be clear that the automatic adjustment described above for margining in accordance with the image displacement can also be used in the case of the longitudinal margining. In that case, positioning an original on the exposure platen in a position which is displaced towards the front or towards the rear with respect to the position which an original normally occupies, the effective area of one of the longitudinal margining bulbs 13 increases accordingly.

While a presently preferred embodiment of the invention has been shown and described in particularity, it may be otherwise embodied within the scope of the appended claims.

What is claimed is:

1. In a copying machine having margining means for rendering zones adjacent to an image image-free and adjustment means for the adjustment of the relative position of said image and image receiving material with respect to each other before transferring said image to said receiving material, the improvement in combination therewith comprising regulating means for adjusting said margining means so as to also render image-free the zone of the image which during the image transfer falls outside said receiving material.

2. The improvement set forth in claim 1, wherein said regulating means is coupled to said adjustment means for the adjustment of the relative position of said image and receiving material, so that said margining means is automatically adjusted for rendering image-free all zones in which image and receiving material do not coincide during the image transfer.

3. The improvement set forth in claims 1 or 2, including means for forming a first and a second image respectively on a first and a second side of said receiving material such that said adjustment means can be adjusted beforehand so as to position the second image on the second side, wherein said regulating means adjust said margining means such as to render image-free the zone of the second image which falls outside the second side of said receiving material during the image transfer, and adjusts said margining means such as to render image-free the zone of the first image which, during the image transfer to the first side, coincides with the zone to be rendered image-free of the second image on the second side.

* * * * *